United States Patent [19]

Alvarez et al.

[11] Patent Number: 4,539,145

[45] Date of Patent: Sep. 3, 1985

[54] OUTSIDE WINDOW CLEANER CONTAINING POLYVINYL ALCOHOL AND AMINE-CONTAINING POLYMER

[75] Inventors: Vincent E. Alvarez, Livermore; David L. Conkey, San Ramon, both of Calif.

[73] Assignee: The Clorox Company, Oakland, Calif.

[21] Appl. No.: 532,635

[22] Filed: Sep. 15, 1983

[51] Int. Cl.[3] ..... C11D 1/38; C11D 1/66; C11D 3/37; C11D 17/08

[52] U.S. Cl. ..... 252/542; 252/174.21; 252/174.23; 252/524; 252/544; 252/547; 252/DIG. 1; 252/DIG. 2; 252/DIG. 3; 252/DIG. 10; 525/58

[58] Field of Search ..... 525/58; 252/102, 174.21, 252/174.23, 524, 542, DIG. 2, DIG. 3, DIG. 10, DIG. 15

[56] References Cited

U.S. PATENT DOCUMENTS

| | | | |
|---|---|---|---|
| 2,798,047 | 7/1957 | Touey et al. | 252/152 |
| 3,152,993 | 10/1964 | Touey | 252/542 |
| 3,251,800 | 5/1966 | Cooley et al. | 260/39 |
| 3,629,122 | 12/1971 | Jakobi | 252/544 |
| 3,679,589 | 7/1972 | Schnegelberger | 252/102 |
| 3,771,951 | 11/1973 | Berni | 8/137 |
| 3,819,525 | 6/1974 | Hattenbrun | 252/132 |
| 3,852,220 | 12/1974 | Kimmel | 252/524 |
| 3,898,186 | 8/1975 | Mermelstein | 252/528 |
| 3,979,339 | 9/1976 | Claybaugh | 252/524 |
| 4,038,082 | 7/1977 | Yoshida | 427/340 |
| 4,123,278 | 10/1978 | van Paesschen | 525/155 |
| 4,151,127 | 4/1979 | Perner et al. | 252/542 |
| 4,234,212 | 10/1980 | Kato | 282/27.5 |
| 4,368,146 | 1/1983 | Aronson | 252/542 |

FOREIGN PATENT DOCUMENTS

| | | |
|---|---|---|
| 3024257 | 1/1981 | Fed. Rep. of Germany . |
| 1349567 | 4/1974 | United Kingdom . |

*Primary Examiner*—Dennis L. Albrecht

*Attorney, Agent, or Firm*—Joel J. Hayashida; Stephen M. Westbrook

[57] ABSTRACT

An outside window cleaner comprising mixtures of one or more polyvinyl alcohols with water, or preferably, polyvinyl alcohol, a cationic polymer, such as trimethylol melamine, and water, alters or modifies window or other hard surfaces such that water drains off in uniform sheets, leaving virtually no residue or spots caused from the deposition of dirt, cleaning compositions or a combination of the two. In a further embodiment, a selected cationic or nonionic surfactant is added to the formula of this invention to improve detergency while retaining the uniform drainage advantage in rinsing.

7 Claims, No Drawings

OUTSIDE WINDOW CLEANER CONTAINING POLYVINYL ALCOHOL AND AMINE-CONTAINING POLYMER

BACKGROUND OF THE INVENTION

Compositions currently available for cleaning windows or other large, hard surfaces, suffer from many defects. The typical window cleaner is some sort of liquid detergent, that is, some mixture of water soluble surfactants and solvents. These types of cleaners appear to display adequate detergency, but require a great number of steps to clean the surface to which it is applied, i.e., applying the composition to the window or other hard surface, reciprocating with a brush, squeegee, sponge or other abradent, and then removing the composition by wicking it onto some absorbent surface, e.g., a sponge or paper towels. However, if these cleaners are not totally removed from the window or other hard surface, rinsing the window or other hard surface will result, typically, in spotting caused by deposition of soils, cleaning composition, or a combination of the two. There are other window cleaners, such as highly alkaline formulations, e.g., tri-sodium phosphate, which is the tri-substituted salt of phosphoric acid. These particular compositions are impractical for every day use since tri-sodium phosphate is a very strong alkali and may cause corrosion or pitting of metal surfaces, e.g., window frames etc. Further such other cleaners still do not address the problem of spotting or residue remaining after rinse.

Therefore, there has been heretofore no prior art cleaner which effectively removes soils, and can be rinsed off without the need for the prior step of scraping, wiping or wicking off the cleaner used. Further, no prior art cleaner has solved the problem of spotting or leaving of residues of cleaner, soils, or a combination of the two.

The combination of polyvinyl alcohols and trimethylol melamine has been disclosed for use as a wet paper process additive to increase the wet strength of paper. However, this application neither recognizes that such combinations of polyvinyl alcohol and trimethylol melamine could be used as hard surface cleaners, nor that its use would cause rinse water to drain in uniform sheets off the surface cleaned.

DISCLOSURE OF THE INVENTION

This invention relates to an improved method and composition for cleaning hard surfaces, especially glass windows, comprising a cleaning composition comprising:

(a) at least one polyvinyl alcohol; and (b) at least 80.0% water.

This cleaning composition is to be applied to a hard surface, thus altering said hard surface thereby, such that water used to rinse said hard surface drains off in uniform sheets.

In another embodiment of the invention is provided a cleaning composition for cleaning hard surfaces and altering the surface properties thereof comprising:

(a) a first polyvinyl alcohol;

(b) a tri-substituted, heterocyclic amine or a second polyvinyl alcohol; and (c) water.

In the first two embodiments of this invention, the cleaning compositions cause the alteration or modification of the surface properties of the hard surfaces treated such that water used to rinse said surfaces drains off in uniform sheets, without leaving any substantial residue or deposits.

In yet another embodiment, the invention includes a composition of matter and a method of cleaning hard surfaces using the same comprising:

(a) a first polyvinyl alcohol;

(b) a tri-substituted heterocyclic amine or a second polyvinyl alcohol;

(c) nonionic or cationic surfactants; and (d) water.

This embodiment provides additional detergency while retaining the uniform draining benefit when the hard surface is rinsed. This is because addition of the cationic or nonionic surfactant has been found to give greater cleaning benefits while retaining the uniform sheeting advantages.

DETAILED DESCRIPTION OF THE INVENTION

The present invention provides a novel composition for cleaning hard surfaces, especially glass windows, without having to remove the cleaners used thereon, and wherein the surface thus cleaned will be left virtually spot-free upon rinsing with water. This is achieved because the novel compositions of the present invention, when used to clean such hard surfaces, alter the surface of the hard surfaces causing water to sheet and drain uniformly and rapidly.

In the broadest embodiment of the invention disclosed is a cleaning composition, and a method of using the same, comprising:

(a) at least one polyvinyl alcohol; and (b) at least 80.0% water.

Said composition when applied to a hard surface, such as a large window, alters or modifies it such that water used to rinse the hard surface drains off in uniform sheets. By draining off in this manner, virtually no residue or spotting caused by the deposition of dirt, formulation, water hardness or a combination thereof, remains.

The polyvinyl alcohols utilized in this invention have the general structure $$-\left|-CH_2-\underset{OH}{CH}-\right|_n-$$

wherein n is an integer of no more than about 9,000.

Thus, polyvinyl alcohols in this invention should have a weight average of 22,000 to 400,000, preferably 75,000 to 100,000. Preferably polyvinyl alcohols which are at least 80.0%, preferably 88–99.9%, and most preferably 99.0–99.8%, hydrolyzed are utilized. An example of one such polyvinyl alcohol is Elvanol 71–30 manufactured by E. I. DuPont de Nemours and Company, Wilmington, Del. Polyvinyl alcohols are condensation polymers of vinyl acetate and water. They are present by weight up to 10.0%, preferably 0.00010 to 7.5%, most perferably 0.010 to 5.0%. Further, additional polyvinyl alcohols may be added to the compositions of this invention to produce the desired sheeting action. The additional polyvinyl alcohols are generally of different molecular weights than the first. For example, in one preferred embodiment, a first polyvinyl alcohol with a molecular weight averaging 220,000 is added to a second polyvinyl alcohol with a molecular weight averaging 26,000. Further examples of these embodiments are contained in TABLES I–II.

It is not presently completely understood why the composition comprising water and one or more polyvinyl alcohols will cause hard surfaces treated with such compositions to become altered. Such hard surfaces are modified, such that rinse water adheres or clings quite tenaciously. While not wishing to be bound to any one particular theory, applicants have speculated that there may be intermolecular attractions between the polyvinyl alcohols' carbon chains and the random molecules of the hard surface treated. For example if the surface treated is a vertical glass surface, some stray SiOH groups may extrude from the surface, and cause to be attracted to certain groups on the polyvinyl alcohols via hydrogen bonding, Van der Waals forces, etc. Therefore, when water or other solutions are used to rinse the hard surface treated, the water adheres or "clings" tenaciously to the surface. The applicants suspect that the surfaces have been caused to become more hydrophilic. Thus, the water, instead of forming droplets or beading up, remains in uniform sheets.

In another embodiment of this invention, a further composition is utilized herein, namely a polymer containing at least one secondary or primary amino group.

A polymer of this type may be reacted with the polyvinyl alcohols of this invention. Hence, as an example, polyvinyl alcohol may be reacted with a polymer with amino functional groups, wherein the polymer is an oligomer. One particularly preferred oligomer is a tri-substituted, heterocyclic amine. This oligomer and polyvinyl alcohol are combined in an acidic reaction to form a cationic reaction product.

As examples of oligomers, the tri-substituted, heterocyclic amines used in this invention include trimethylol melamine.

Trimethylol melamine has the general structure:

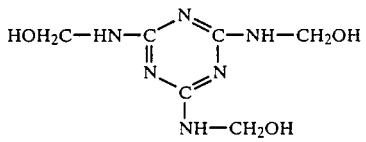

One example of a trimethylol melamine which is utilized in this formula is Parez 607 manufactured by American Cyanamid Company. These amines are extremely reactive compounds, due to the presence of the highly reactive nitrogen groups. They are the reaction products of melamine and formaldehyde in the presence of mineral acids.

Other polymers having at least some primary or secondary amino functional groups may be suitable for use in this invention. Other cationic agents may also be suitable for use in this invention, particularly dimethylol ethylene urea, triazone resins, and dialdehydes.

The preferred combination of polyvinyl alcohol and trimethylol melamine are believed to form a reaction product, of which the following structure is exemplary:

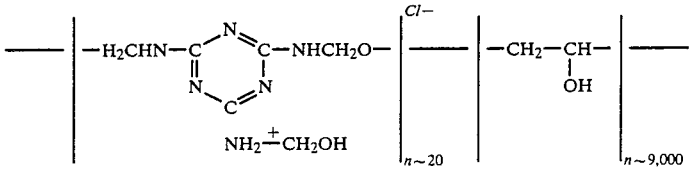

Because the polyvinyl alcohol/tri-substituted amine reaction product used in this invention is a cationic complex, the reaction of the two preferably takes place in an acidic, low pH environment. This is supplied by the addition of a mineral acid, such as hydrochloric acid. Hydrochloric acid can be supplied by using appropriate amounts of 12N, 6N, 3N, etc. HCl. 12N HCl is approximately 36.5% HCl in aqueous solution. Further, HCl-containing products, such as muriatic acid may be used. Other mineral acids may be suitable for use, for example, sulfuric, sulfurous, nitric, nitrous, and phosphoric acids. The preferable ratio of such mineral acids to trimethylol melamine (TMM) is 0.8% acid: 1.0% TMM, most preferably no higher than 0.3% acid: 1.0% TMM. Thus, relatively minor amounts of acids are added, from 0.0001–1.0%.

It is preferable that the ratio of polyvinyl alcohol to tri-substituted amines be approximately 15:1 to 1:15, preferably 8:1 to 1:8 and most preferably 4:1.0 to 1:4.0. Further, percentages of the polyvinyl alcohol/trimethylol melamine complex used can range up to 10.0%, but preferably from 0.00010 to 7.5%, and most preferably from 0.010 to 5.0%, by weight of the total composition. In this embodiment, even better results are obtained. Uniform sheeting appears enhanced, likely due to the particularly cationic nature of the compositions used.

As heretofore explained, the precise mechanism for the sheeting action of the water draining off hard surfaces is not entirely understood, and it is also not understood why addition of a trisubstituted heterocyclic amine enhances the sheeting action. However, at least two theories have been postulated for this phenomenon.

The first theory is that in the association of the polymeric compound (polyvinyl alcohol for example) and the oligomeric compound (trimethylolmelamine), the oligomer acts as a cross-linking agent. Hence, the oligomer would act as the bridge between various pieces of the polymer.

Yet another theory is that ester bonds form between the trimethylolmelamine moieties causing bonds to form throughout the oligomer/polymer complex.

Mineral acids, such as hydrochloric acid, appear necessary to promote the cationic environment in which the reaction takes place. However, other mineral acids, eg., sulfuric, sulfurous, nitric, nitrous and phosphoric acids, may also be effective for use.

Yet further theories are presented as to why the sheeting action occurs. First, in a typical vertical hard surface, e.g., a glass window, the silicon dioxide ($SiO_2$) has negative charges extruding from the window surface. Because of these charges, ionic forces may cause attraction to the cationic (positively charged) moieties of the trimethylol melamine/polyvinyl alcohol complex. Hence, this would cause a binding of the polymeric/oligomeric complex to the window surface. This would then promote uniform sheeting since the polymer is a hydrophilic compound and would cause water to adhere to it, thus leading to the uniform sheeting action. It is possible that the water may also be attracted to the surface of the polyvinyl alcohol due to hydrogen bonding, van der Waals and other intramolecular forces.

The following examples depict some preferred embodiments of the invention which are particularly suitable. The applicants, however, do not restrict in any manner the scope of this application thereby.

EXAMPLE 1

| Percent by Weight | Component |
|---|---|
| 99.46% | $H_2O$ |
| 0.1% | Parez 607[1] |
| 0.04% | 38% HCl |
| 0.4% | Elvanol 71-30[2] |
| 100.0% | |

[1]Parez 607 is a trademark of the American Cyanamid Company for trimethylolmelamine.
[2]Elvanol 71-30 is a trademark of E.I. Du Pont de Nemours and Company for polyvinyl alcohol.

Example 1 produced a smooth flowing liquid composition. This composition was used to clean the window as follows:

The liquid was freely applied to a soiled window surface and rubbed. Thereafter, without removing, i.e., wiping, wicking, or scraping away the composition from the window surface, the window surface was rinsed with copious amounts of water. The water drained off rapidly and uniformly in sheets. Upon drying, no spotting or other residue was noted on the window, leaving a virtually streak-free and spot-free surface. Further results are documented in TABLES III--VI, below.

In another embodiment of this invention, nonionic surfactants may be added to the foregoing composition for improved detergency without loss of the rapid and uniform drainage aspect of the foregoing invention. This is shown in the following example:

EXAMPLE 2

| Percent by Weight | Component |
|---|---|
| 98.96% | $H_2O$ |
| 0.1% | Parez 607[1] |
| 0.04% | 38% HCl |
| 0.4% | Elvanol 71-30[2] |
| 0.5% | Pluronic 25R2[3] |
| 100.0% | |

[1]Trademark of the American Cyanamid Company for trimethylolmelamine.
[2]Elvanol 71-30 is a trademark of E.I. Du Pont de Nemours and Company for polyvinyl alcohol.
[3]Pluronic 25R2 is a trademark of BASF/Wyandotte for an ethylene oxide/propylene oxide block co-polymer, nonionic surfactant.

Surprisingly, addition of nonionic surfactants, such as those used in Example 2, add detergency to the compositions of the present invention and do not affect the sheeting action of the trimethylol melamine/polyvinyl alcohol complex.

Further examples of surfactants which may be used in this invention are nonionic surfactants such as nonylphenoxy poly(ethyleneoxy)ethanol, and further long chain phenoxy poly(ethyleneoxy)ethanols averaging up to 20 carbons. Further, linear, primary or secondary alcohol ethoxylates or propoxylates averaging up to 20 carbons and averaging 1–30 moles of ethylene or propylene oxide, or mixture thereof, per mole of alcohol, are suitable for use in this invention. Still further nonionic surfactants are octyl phenoxy polyethoxy ethanols. Other examples of nonionic surfactants which may be suitable for use in this invention may be found in Kirk-Othmer, *Encyclopedia of Chemical Terminology* 2d, Vol. 19, pages 531–554, which are incorporated herein by reference. Surfactants are added to the compositions of this invention in percentages of 0.0001 to 10.0%, preferably 0.01 to 5.0%.

While other surfactants may be utilized in the compositions of this invention containing surfactant, it has been shown that anionic surfactants may generally be undesirable in the compositions of this invention. These particular surfactants either are insoluble in compositions of this invention, or deleteriously affect the sheeting action of the cationic polyvinyl alcohol/trimethylolmelamine complex, or both. However, it has been found that at least two examples of cationic surfactants are suitable for use in this invention. These two examples are: Ammonyx 4080 and Onamine 16.

Ammonyx 4080 and Onamine 16 are trademarks of the Onxy Oils and Resins Company. Ammonyx 4080 is a dialkyl imidazolinium methyl sulfate, and Onamine 16 is a hexadecyl dimethyl amine. Further results may be seen by consulting TABLES VII to VIII, below.

TABLE I

EXPERIMENTAL
Formulas Containing Mixtures of Polyvinyl Alcohols

| EXAMPLES | VINOL 350[1] | VINOL 107[2] | VINOL 540[3] | VINOL 205[4] |
|---|---|---|---|---|
| 3 | .000 | .000 | .000 | .500 |
| 4 | .000 | .000 | .500 | .000 |
| 5 | .000 | .500 | .000 | .000 |
| 6 | .500 | .000 | .000 | .000 |
| 7 | .000 | .167 | .167 | .167 |
| 8 | .167 | .000 | .167 | .167 |
| 9 | .167 | .167 | .000 | .167 |
| 10 | .167 | .167 | .167 | .000 |
| 11 | .000 | .000 | .250 | .250 |
| 12 | .000 | .250 | .000 | .250 |
| 13 | .000 | .250 | .250 | .000 |
| 14 | .250 | .000 | .000 | .250 |
| 15 | .250 | .000 | .250 | .000 |
| 16 | .250 | .250 | .000 | .000 |
| 17 | .125 | .125 | .125 | .125 |
| 18 | .125 | .125 | .125 | .125 |
| 19 | .125 | .125 | .125 | .125 |

[1]Vinol 350 is a trademark of Air Reduction Company, for a 98.0–98.8% hydrolyzed polyvinyl alcohol with a molecular weight averaging 220,000.
[2]Vinol 107 is a 98.0–98.8% hydrolyzed polyvinyl alcohol with a molecular weight averaging 40,000.
[3]Vinol 540 is an 87.0–89.0% hydrolyzed polyvinyl alcohol with a molecular weight averaging 110,000.
[4]Vinol 205 is an 87.0–89.0% hydrolyzed polyvinyl alcohol with a molecular weight averaging 26,000.

The formulas contained in EXAMPLES 3–19 of TABLE I were graded for overall appearance according to a subjective test by impartial graders. As shown in TABLE II, below, grading of windows treated with these formulas was done on a 1 to 5 scale, wherein a 5.0 grading indicates no film or residue, 3.0 indicates medium film or residue, and 1.0 indicates heavy film or residue.

Regardless of the outcome of this test, however, most of these formulas displayed the desirable uniform sheeting action. TABLE II sets forth the sheeting times, or length of time broad sheets of rinse water visibly cascaded down the window surface, and the average overall appearance grades. Overall appearances of these formulas were also compared against combinations of: (1) Polyvinyl alcohol/trimethylol melamine/Pluronic 25-R-2 surfactant; (2) 2 Polyvinyl Alcohols (Vinol 350+205); and (3) 2 Polyvinyl Alcohols and Surfactant (Vinol 350; Vinol 205; Pluronic 25-R-2).

TABLE II

Sheeting Times and Overall Appearance of Rinse Water Observed for above Formulas

| EXAMPLE | SHEET-TIME(sec) | FILM | Average Overall Appearance |
|---|---|---|---|
| 3 | 15.0 | 162.0 | 2.5 |
| 4 | 50.0 | 133.0 | 2.0 |
| 5 | 2.0 | 180.0 | 1.4 |
| 6 | 3.5 | 168.0 | 1.4 |
| 7 | 20.0 | 160.0 | 1.3 |
| 8 | 25.0 | 140.0 | 3.4 |
| 9 | 10.0 | 160.0 | 1.6 |
| 10 | 27.5 | 148.0 | 3.5 |
| 11 | 20.0 | 155.0 | 2.0 |
| 12 | 10.0 | 164.0 | 2.5 |
| 13 | 30.0 | 150.0 | 3.5 |
| 14 | 10.0 | 176.0 | 3.4 |
| 15 | 32.5 | 142.0 | 2.8 |
| 16 | 11.0 | 176.0 | 1.6 |
| 17 | 20.0 | 168.0 | 1.6 |
| 18 | 20.0 | 148.0 | 1.5 |
| 19 | 25.0 | 170.0 | 1.0 |
| 4:1 Polyvinol Alcohol/Trimethylolmelamine + Pluronic 25-R-2 surfactant | | | 4.5 |
| Vinol 350 + Vinol 205 | | | 2.8 |
| Vinol 350 + Vinol 205 + Pluronic 25-R-2 surfactant | | | 1.1 |

PREPARATION OF PVA/TMM FORMULAS

2% Polyvinyl Alcohol/Trimethylol Melamine Solutions were prepared in 0.4:1, 1:1, 4:1 and 10:1 ratios, as follows:

1. A 6% Trimethylol Melamine (TMM) acid colloid was prepared by agitating, respectively, distilled, $H_2O$, 38% HCl, and TMM Parez 607 (trademark of American Cyanamid Co., Lot 782-688) for 3 hours. A further quantity of distilled water is added. pH values were then measured twice for each batch. The quantities of material and were:

TABLE III

| Material | (6.0% TMM Solutions) For 0.4:1 | For 1:1 | For 4:1 | For 10:1 |
|---|---|---|---|---|
| Distilled $H_2O$ | 338.92 | 237.23 | 94.90 | 43.12 |
| 38% HCl | 17.26 | 12.10 | 4.83 | 2.20 |
| TMM | 48.57 | 34.00 | 13.60 | 6.18 |
| Distilled $H_2O$ | 404.75 | 283.33 | 113.33 | 51.50 |
| Total (by weight) | 809.50 | 566.67 | 226.67 | 103.00 |

2. A 2% Polyvinyl Alcohol (PVA) solution was prepared by mixing PVA (Elvanol 71-30, Du Pont Company's trademark for 99.0-99.8% hydrolyzed PVA) with distilled water, with stirring.

This solution was further heated to 85°-90° C. with constant stirring. The quantities of materials used were:

TABLE IV

| Material | (2.0% PVA Solutions) For 0.4:1 | For 1:1 | For 4:1 | For 10:1 |
|---|---|---|---|---|
| Distilled $H_2O$ | 952.07 | 1666.00 | 2665.60 | 3029.18 |
| PVA | 19.43 | 34.00 | 54.40 | 61.82 |
| Total (by weight) | 971.50 | 1700.00 | 2720.00 | 3091.00 |

3. To assemble the 0.4:1, 1:1, 4:1, and 10:1 2.0% TMM/PVA solutions, each of the 2.0% PVA solutions in TABLE IV were added to the 6.0% TMM acid colloids of TABLE III with constant stirring for 15 minutes. An additional quantity of water was added, at temperatures between 65° to 85° C. Final pH's were measured.

TABLE V

| Material | 0.4:1 PVA/TMM | 1:1 PVA/TMM | 4:1 PVA/TMM | 10:1 PVA/TMM |
|---|---|---|---|---|
| 2.0% PVA Solutions | 971.50 | 1700.00 | 2720.00 | 3091.00 |
| 6.0% TMM Acid Colloids | 809.50 | 566.67 | 226.67 | 103.00 |
| Distilled $H_2O$ | 1619.00 | 1133.33 | 453.33 | 206.00 |
| Totals* | 3400.00 | 3400.00 | 3400.00 | 3400.00 |
| pH | 2.03 | 2.56 | 3.40 | 4.24 |

*Sample Calculation:
For 0.4:1 PVA/TMM Solution .02 × 971.50 = 19.43 = 0.40:1
.06 × 809.50 = 48.57

TABLE VI

Sheeting Performance for Preferred PVA/TMM Formulas

| EXAMPLE | FORMULA | PRECONDITIONING | RELATIVE[4] SHEETING | COMMENTS |
|---|---|---|---|---|
| 20. | 0.00017% (4:1)PVA/TMM | 1 | 3.0 | Caused some sheeting with many droplets |
| 21. | 0.00890% (4:1)PVA/TMM | 1 | 3.0 | Sheeting better than 1; fewer droplets |
| 22. | 0.89000% (4:1)PVA/TMM | 1 | 4.5 | Sheeting very uniform; very few droplets |
| 23. | 0.89000% (4:1)PVA/TMM | 3 | 4.0 | Sheeting not as uniform; more droplets |
| 24. | 0.1000% (4:1)PVA/TMM | 2 | 4.0 | Sheeting uniform; scattered droplets |
| 25. | 1.0000% (4:1)PVA/TMM | 2 | 4.5 | Sheeting very uniform; few droplets |
| 26. | 1.7800% (4:1)PVA/TMM | 2 | 5.0 | Sheeting very uniform; few droplets |
| 27. | 0.1000% (4:1)PVA/TMM | 3 | 4.0 | Sheeting uniform |
| 28. | 1.0000% (4:1)PVA/TMM | 3 | 4.0 | Sheeting very uniform |
| 29. | 1.7800% (4:1)PVA/TMM | 3 | 5.0 | Sheeting very uniform |

[1]Cleaned with 10.0% Sodium Tripolyphosphate (STP); rinsed.
[2]Cleaned with 10.0% STP; rinsed; cleaned again with Sunburst glass cleaner (Trademark of The Clorox Company).
[3]Not precleaned
[4]Relative Sheeting is a subjective performance test, graded by an impartial tester based on a 1 to 6 scale, wherein 1 = no sheeting, water runs off with copious droplets forming, to 6 = uniform sheeting, rinse water clings tenaciously to the surface. The water hence evaporates uniformly rather than runs off.

Considering TABLE VII, the following observations were made:

1. Sheeting improved as the concentration relative to PVA increased. Further, the rinse water clung more tenaciously to the surface treated.

2. Fewer water droplets are left behind with increased PVA concentrations.
3. Dirty windows decrease sheeting action markedly, since more water droplets are observed remaining on glass which was not pre-cleaned prior to treatment.

TABLE VII

| CATIONIC SURFACTANT | Surfactants Tested CONCENTRATION 0.40 | 0.04 | 0.004 | NONIONIC SURFACTANT | CONCENTRATION % (wt) 0.40 | 0.004 |
|---|---|---|---|---|---|---|
| Ethomeen 0-12[1] | NS/s[10] | NS/s | s/film[13] | Pluronic F-38[14] | S | S |
| Ethomeen 0-15[2] | NS/s | NS/s | s/film | Pluronic L-64[15] | S | S |
| Ethomeen C-12[3] | NS/s | NS/s | s/film | Pluronic 25R-2[16] | S | S |
| Ammonyx 4080[4] | NS/s | S[12] | S/film | Triton X-45[17] | S | S |
| Ammonyx CA[5] | —[11] | NS/s | S/film | Triton X-102[18] | S | S |
| Ammonyx KP[6] | NS/s | NS/s | NS/s | Triton blend[19] | S | S |
| Onamine 12[7] | NS/s | — | s/film | Neodol 25-3[20] | S | S |
| Onamine 16[8] | NS/s | S | s/film | Neodol 25-12[21] | S | S |
| Onamine RO[9] | NS/s | NS/s | NS/s | Igepal CO-850[22] | S | S |

[1]Ethomeen 0-12, a trademark of Armour Industrial Chemicals, is an ethylene oxide condensation product of an oleic fatty amine, averaging 12 moles of ethylene oxide.
[2]Ethomeen 0-15, a trademark of Armour Industrial Chemicals, is an ethylene oxide condensation product of an oleic fatty amine, averaging 15 moles of ethylene oxide.
[3]Ethomeen C-12, a trademark of Armour Industrial Chemicals, is an ethylene oxide condensation product of a coco fatty amine, averaging 12 moles of ethylene oxide.
[4]Ammonyx 4080, a trademark of Onyx Oils & Resins, Inc., is a dialkyl imidazolinium methyl sulfate.
[5]Ammonyx CA, a trademark of Onyx Oils & Resins, Inc., is a stearyl dimethyl benzylammonium chloride.
[6]Ammonyx KP, a trademark of Onyx Oils & Resins, Inc., is an oleyl dimethyl benzylammonium chloride.
[7]Onamine 12, a trademark of Onyx Oils & Resins, Inc., is a dodecyl dimethyl amine.
[8]Onamine 16, a trademark of Onyx Oils & Resins, Inc., is a hexadecyl dimethyl amine.
[9]Onamine RO is a 1-(2-hydroxyethyl), 2n-heptadecenyl, 2-imidazoline.
[10]NS/s: Glass does not sheet, water spots on glass pane.
[11]—: Surfactant was insoluble in Polyvinyl Alcohol/Trimethylol melamine solution.
[12]S: Glass sheets for more than 50 seconds.
[13]s/film: Water spots and film left on glass pane.
[14]Pluronic F-38, a trademark of B.A.S.F. Wyandotte, is an ethylene oxide/propylene oxide oxide block co-polymers, containing 3 moles of propylene oxide to 8 moles of ethylene oxide.
[15]Pluronic L-64, a trademark of B.A.S.F. Wyandotte, Industrial Chemical Group, is a block co-polymer comprising condensates of ethylene oxide with hydrophobic bases formed by condensing propylene oxide with propylene glycol, with a hydrophilic/lipophilic balance (HLB) averaging 11.0.
[16]Pluronic 25R-2, a trademark of B.A.S.F. Wyandotte, Industrial Chemical Company Group, is a block co-polymer comprising condensates of propylene oxide with hydrophilic bases formed by condensing ethylene oxide with ethylene glycol.
[17]Triton X-45, a trademark of Rohm & Haas Company, is an octyl phenoxy polyethoxy ethanol averaging 5 moles of ethylene oxide per mole of hydrophobic moiety, with a hydrophilic/lipophilic balance (HLB) averaging 10.4.
[18]Triton X-102, a trademark of Rohm & Haas Company, is another octyl phenoxy polyethoxy ethanol with an HLB averaging 14.6.
[19]Triton Blend is a 4:1 mixture of Triton X-45 and X-102.
[20]Neodol 25-3, a trademark of Shell Chemical Company, is an alcohol ethoxylate averaging 12–15 carbon atoms with an average of 3 moles of ethylene oxide per mole of alcohol and with an HLB averaging 7.8.
[21]Neodol 25-12, a trademark of Shell Chemical Co., is an alcohol ethoxylate averaging 12–15 carbon atoms with an average of 12 moles of ethylene oxide per mole of alcohol and with an HLB averaging 14.4.
[22]Igepal CO-850, a trademark of G.A.F. Corp., is a nonyl phenoxy poly (ethyleneoxy) ethanol, with an HLB averaging 16.0.

Preferred surfactant/polyvinyl/alcohol/trimethylolmelamine complex combinations were tested. The results, which are tabulated in TABLE VIII, represent a best mode of this particular embodiment of the invention, but are not meant to restrict the scope of the invention thereby.

In conducting these tests, sample glass panes were pre-tested. This allows for development of a uniform hydrophilic character on the glass surfaces. The panes were soaked in potassium hydroxide/ethanol solution, scrubbed, and rinsed in distilled water. The panels were then scrubbed in Liquinox (trademark of American Cyanamid Company) and rinsed again with distilled water. They were then cured overnight at 85° C.

These panels which were soiled, had the following Chemical Specialties Manufacturing Association (C.S.M.A.) test soil applied:

| Material | Weight % |
|---|---|
| Enreco Mineral Oil No. 32 | 0.75% |
| Kaopaque No. 10 | 0.75% |
| Perchloroethylene | 98.50% |
| | 100.00% |

The surfactant/polymer blends were then prepared as follows:

A 2.0% aqueous solution of 4:1 polyvinyl alcohol to trimethylol melamine was prepared and diluted to 0.5% total solids content. Then, 0.5% by weight of the chosen surfactants were added. The typical example here was:

| Material | Weight % |
|---|---|
| 2.0% PVA/TMM | 28.7% |
| Surfactant | 0.5% |
| Distilled Water | 70.8% |
| | 100.0% |

Visual assays, as reported in TABLE VIII below, were conducted by impartial graders as follows:

| Visual Grade Scale: Paired Comparison | |
|---|---|
| Grade | |
| +4 = | I see a large difference and I prefer A to B |
| +3 = | I see a moderate difference and I prefer A to B |
| +2 = | I see a slight difference and I prefer A to B |
| +1 = | I think I see a difference and I prefer A to B |
| 0 = | No difference |
| −1 = | I think I see a difference and I prefer B to A |
| −2 = | I see a slight difference and I prefer B to A |
| −3 = | I see a moderate difference and I prefer B to A |
| −4 = | I see a large difference and I prefer B to A |

The panes were judged by using a Black Box equipped with overhead fluorescent lights for viewing glass panes. Two glass panes were set two inches apart and placed vertically, tilted against the inside ledge of the Black Box and directly under the fluorescent lights. Only box lights were turned on. Judges were asked to compare and grade a set of glass panes according to the scale above. The judge's preference to a glass treatment is indicated by a positive or negative grade; normally, a positive grade indicates preference to the left (A) glass pane while a negative grade indicates preference to the right pane (B). The formulas plug surfactant were compared against a soiled glass pane cleaned with Windex (trademark of Drackett Company), an untreated, soiled glass pane, and a clean, unsoiled glass pane.

TABLE VIII

VISUAL SCORES FROM CLEANING PERFORMANCE TEST

Paired Comparison A versus B

| | B COMPARISON TREATMENTS | | |
|---|---|---|---|
| NONIONIC SURFACTANT | WINDEX[13] | SOILED GLASS[14] | CLEAN GLASS |
| 1 Pluronic 25R-2[1] | +2.3 | +4 | −0.6 |
| 2 Triton X-45[2] | +2.3 | +4 | −0.6 |
| 3 Pluronic L-64[3] | +2.3 | +4 | −1.0 |
| 4 Neodol 25-3[4] | +2 | +4 | −2.0 |
| 5 Igepal CA-887[5] | +2.6 | +3.3 | −1.3 |
| 6 Igepal CA-720[6] | +3.3 | +3 | −2.6 |
| 7 Pluronic F-38[7] | +3.0 | +3.3 | −2.6 |
| 8 Igepal CO-850[8] | +1.0 | +2.0 | −2.6 |
| 9 Triton X-102[9] | +0.6 | +2 | −2.6 |
| 10 Triton Blend[10] | 0 | +3 | −2.6 |
| 11 Igepal CA-630[11] | 0 | +1.6 | −2.6 |
| 12 Neodol 25-12[12] | −0.6 | +1 | −4.0 |
| Clean Glass | +4.0 | — | — |

[1]Pluronic 25R-2, a trademark of B.A.S.F. Wyandotte, Industrial Chemical Group, is a block co-polymer comprising condensates of propylene oxide with hydrophilic bases formed by condensing ethylene oxide with ethylene glycol.

[2]Triton X-45, a trademark of Rohm & Haas Company, is an octyl phenoxy polyethoxy ethanol averaging 5 moles of ethylene oxide per mole of hydrophobic moiety, with a hydrophilic/lipophilic balance (HLB) averaging 10.4

[3]Pluronic L-64, a trademark of B.A.S.F. Wyandotte, Industrial Chemical Group, is another block co-polymer comprising condensates of ethylene oxide with hydrophobic bases formed by condensing propylene oxide with propylene glycol, with an HLB averaging 11.0.

[4]Neodol 25-3, a trademark of Shell Chemical Company, is an alcohol exthoxylate averaging 12–15 carbon atoms with an average of 3 moles of ethylene oxide per mole of alcohol and with an HLB averaging 7.8.

[5]Igepal CA-887, a trademark of G.A.F. Corp., is an octyl phenoxy poly (ethyleneoxy) ethanol, with an HLB averaging 17.4.

[6]Igepal CA-720, a trademark of G.A.F. Corp., is another octyl phenoxy poly (ethyleneoxy) ethanol, with an HLB averaging 14.6.

[7]Pluronic F-38, a trademark of B.A.S.F. Wyandotte, Industrial Chemical Group, is a further block co-polymer comprising condensates of ethylene oxide with hydrophobic bases formed by condensing propylene oxide with propylene glycol.

[8]Igepal CO-850, a trademark of G.A.F. Corp., is a nonyl phenoxy poly (ethyleneoxy) ethanol, with an HLB averaging 16.0.

[9]Triton X-102, a trademark of Rohm & Haas Company, is another octyl phenoxy polyethoxy ethanol with an HLB averaging 14.6.

[10]Triton Blend is a mixture of Triton X-45 and X-102.

[11]Igepal CA-630, a trademark of G.A.F. Corp., is another octyl phenoxy poly (ethyleneoxy) ethanol with an HLB averaging 13.0

[12]Neodol 25-12, a trademark of Shell Chemical Co., is an alcohol ethoxylate averaging 12–15 carbon atoms with an average of 12 moles of ethylene oxide per mole of alcohol and with an HLB averaging 14.4

[13]Trademark of the Drackett Company.

[14]Soiled glass smeared by rubbing a paper towel across surface.

The foregoing theories and mechanisms postulated to explain the invention are not meant to restrict in any way the scope of the invention. Nor is the title of the invention considered in any way limiting of the invention. For example, the cleaner of the invention could also be used on various other hard surfaces, for example, outside walls, vertical hard surfaces, or other polished surfaces which are exposed to the environment, require frequent cleaning, and which are subject to spotting from soil, cleaning compositions, or a combination of the two.

What is claimed is:

1. A composition for cleaning and altering hard surfaces such that water used to rinse said hard surface drains off in uniform sheets without leaving significant residue or spotting after rinsing comprising:
   (a) No more than about 10% of at least one polyvinyl alcohol having average molecular weight of about 22,000 to 400,000;
   (b) At least 80.0% water;
   (c) About 0.0001 to 10.0% of a cationic or nonionic surfactant to add detergency to the composition without deleteriously affecting the sheeting action of rinse water from said hard surface; and
   (d) A polymer containing at least one primary or secondary amino functional group, said polymer being selected from the group consisting essentially of trimethylol melamine, dimethyl ethylene urea, triazone resins and dialdehydes, wherein said polymer of (d) and said polyvinyl alcohol of (a) are present in a ratio of about 15:1 to 1:15.

2. The composition of claim 1 wherein (d) is the reaction product of melamine and formaldehyde in the presence of a mineral acid.

3. The composition of claim 1 wherein (c) is at least one nonionic surfactant selected from the group consisting essentially of: ethoxylated or propoxylated primary or secondary alcohols averaging up to 20 carbon atoms and averaging 1 to 30 moles of ethylene or propylene oxide, or mixtures thereof, per mole of alcohol; alkyl phenoxy (ethyleneoxy) alcohols averaging up to 20 carbon atoms in the alkyl chain and averaging 1 to 30 moles of ethylene oxide; and block co-polymers of ethylene or propylene oxide condensed with bases formed by the condensation of propylene glycol and propylene oxide, or ethylene glycol and ethylene oxide.

4. A method of cleaning hard surfaces without leaving significant residue or spotting after rinsing, comprising:
   applying to a hard surface a cleaning composition which comprises:
   (a) No more than about 10% of at least one polyvinyl alcohol having average molecular weight of about 22,000 to 400,000;
   (b) at least 80.0% water; and
   (c) a polymer containing at least one primary or secondary amine functional group, said polymer being selected from the group consisting essentially of trimethylol-melamine, dimethyl ethylene urea, triazone resins and dialdehydes, wherein said polyer of (c) and said polyvinyl alcohol of (a) are present in a ratio of about 15:1 to 1:15.

5. The method of claim 4 wherein (c) is the reaction product of melamine and formaldehyde in the presence of a mineral acid.

6. The method of claim 4 wherein said cleaning composition further comprises (d) at least one nonionic or cationic surfactant.

7. The method of claim 6 wherein (d) is at least one nonionic surfactant selected from the group consisting essentially of: ethoxylated or propoxylated primary or secondary alcohols averaging up to 20 carbon atoms and averaging 1 to 30 moles of ethylene or propylene oxide or a mixture thereof, per mole of alcohol; alkyl phenoxy, (ethyleneoxy) alcohols averaging up to 20 carbon atoms in the alkyl chain and averaging 1 to 30 moles of ethylene oxide; and block co-polymers of ethylene or propylene oxide condensed with bases formed by the condensation of propylene glycol and propylene oxide, or ethylene glycol and ethylene oxide.

* * * * *